US007907881B2

(12) United States Patent
Kayahara et al.

(10) Patent No.: US 7,907,881 B2
(45) Date of Patent: Mar. 15, 2011

(54) TRANSFER-FIXING DEVICE, IMAGE FORMING APPARATUS, AND TRANSFER-FIXING METHOD

(75) Inventors: Shin Kayahara, Yokohama (JP); Takashi Fujita, Yokohama (JP); Takeshi Takemoto, Yamato (JP); Hiromitsu Takagaki, Yokohama (JP); Takashi Seto, Yokohama (JP); Hirohmi Tamura, Ebina (JP)

(73) Assignee: Ricoh Company Limited, Tokyo (JP)

( * ) Notice: Subject to any disclaimer, the term of this patent is extended or adjusted under 35 U.S.C. 154(b) by 15 days.

(21) Appl. No.: 12/042,143

(22) Filed: Mar. 4, 2008

(65) Prior Publication Data

US 2008/0219717 A1 Sep. 11, 2008

(30) Foreign Application Priority Data

Mar. 5, 2007 (JP) ..... 2007-053849

(51) Int. Cl.
*G03G 15/16* (2006.01)
*G03G 15/11* (2006.01)
*G03G 15/20* (2006.01)

(52) U.S. Cl. ..... 399/307; 399/122; 399/320; 399/330

(58) Field of Classification Search ..... 399/121, 399/122, 239, 251, 268, 320, 322, 330, 335, 399/307

See application file for complete search history.

(56) References Cited

U.S. PATENT DOCUMENTS

| | | | | |
|---|---|---|---|---|
| 3,853,552 | A * | 12/1974 | Namika | 430/124.1 |
| 4,553,149 | A * | 11/1985 | Yano | 347/151 |
| 5,041,718 | A * | 8/1991 | d'Hondt et al. | 219/255 |
| 5,555,185 | A * | 9/1996 | Landa | 399/308 |
| 5,636,349 | A * | 6/1997 | Landa et al. | 399/307 |
| 5,655,202 | A * | 8/1997 | Yoshimura et al. | 399/330 |
| 6,390,617 | B1 * | 5/2002 | Iwao | 347/102 |
| 6,606,472 | B1 * | 8/2003 | Mori et al. | 399/251 |
| 6,697,597 | B2 * | 2/2004 | Senda | 399/330 |
| 6,754,457 | B2 * | 6/2004 | Ciaschi et al. | 399/92 |
| 7,031,648 | B2 | 4/2006 | Takashi et al. | |
| 7,109,441 | B2 * | 9/2006 | Sanpei et al. | 219/216 |
| 7,127,202 | B2 | 10/2006 | Fujita et al. | |
| 7,233,762 | B2 | 6/2007 | Kunii et al. | |
| 7,299,003 | B2 | 11/2007 | Kurotaka et al. | |

(Continued)

FOREIGN PATENT DOCUMENTS

JP 3042414 3/2000

(Continued)

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

The transfer-fixing device includes an image carrier, a pressing member, a heater, and an electrical field generator. The image carrier carries a toner image. The pressing member presses against the image carrier to form a transfer-fixing nip between the pressing member and the image carrier. The heater heats the toner image carried by the image carrier so that a temperature of the toner image is not higher than Tm +10 degrees centigrade when a toner softening point is Tm degrees centigrade. The electrical field generator forms a transfer electrical field at the transfer-fixing nip.

22 Claims, 6 Drawing Sheets

U.S. PATENT DOCUMENTS

| | | | |
|---|---|---|---|
| 2007/0012676 | A1 | 1/2007 | Koide et al. |
| 2007/0065188 | A1 | 3/2007 | Takagaki et al. |
| 2007/0071511 | A1 | 3/2007 | Suzuki et al. |
| 2007/0212126 | A1 | 9/2007 | Seto et al. |
| 2007/0212129 | A1 | 9/2007 | Takemoto et al. |
| 2007/0218386 | A1 | 9/2007 | Suzuki et al. |
| 2008/0008505 | A1 | 1/2008 | Seto et al. |

FOREIGN PATENT DOCUMENTS

| | | |
|---|---|---|
| JP | 2000-275982 | 10/2000 |
| JP | 2002-240342 | 8/2002 |
| JP | 2004-145260 | 5/2004 |
| JP | 2006-171340 | 6/2006 |

* cited by examiner

TRANSFER-FIXING DEVICE, IMAGE FORMING APPARATUS, AND TRANSFER-FIXING METHOD

CROSS-REFERENCE TO RELATED APPLICATION

The present application is based on and claims priority from Japanese Patent Application No. 2007-053849, filed on Mar. 5, 2007 in the Japan Patent Office, the entire contents of which are hereby incorporated herein by reference.

BACKGROUND OF THE INVENTION

1. Field of the Invention

Exemplary aspects of the present invention relate to a transfer-fixing device, an image forming apparatus, and a transfer-fixing method, and more particularly, to a transfer-fixing device, an image forming apparatus, and a transfer-fixing method for transferring and fixing a toner image on a transfer material.

2. Description of the Related Art

A related-art image forming apparatus, such as a copier, a facsimile machine, a printer, or a multifunction printer having two or more of copying, printing, scanning, and facsimile functions, forms a toner image on a transfer material (e.g., a sheet) according to image data by electrophotography. For example, a charger charges a surface of an image carrier. An optical writer emits a light beam onto the charged surface of the image carrier to form an electrostatic latent image on the image carrier according to the image data. A development device develops the electrostatic latent image with a developer (e.g., toner) to form a toner image on the image carrier. The toner image is transferred from the image carrier onto a sheet via an intermediate transfer member. A fixing device applies heat and pressure to the sheet bearing the toner image to fix the toner image on the sheet. Thus, the toner image is formed on the sheet.

However, when a sheet having a rough surface is used, the intermediate transfer member may not fully conform to the surface of the sheet, and consequently a minute gap is formed between the intermediate transfer member and the sheet. As a result, abnormal electrical discharge occurs at the gap, and the toner image carried by the intermediate transfer member is not properly transferred to the sheet, resulting in a faulty image.

To address this problem, there are examples of a related-art image forming apparatus including a transfer-fixing device for performing a transfer process and a fixation process at the same time. Since the transfer-fixing device transfers a toner image to a sheet while applying heat to the toner image, heated toner particles are softened and melted into a viscoelastic block-like clot, and fixed to the sheet. Accordingly, even when a minute gap is formed between a sheet with a rough surface and a transfer-fixing member, the clotted toner is fixed into the gap, thereby forming a high-quality image.

However, since the transfer material (e.g., plain paper) has very small surface irregularities, when the image carrier contacts the transfer material, a surface of the image carrier including resin or rubber may not conform to such irregularities. Thus, a part of the toner image may fail to contact the transfer material.

FIG. 1 illustrates a transfer-fixing process in which a solid toner image is transferred from an image carrier to a transfer material and fixed thereon at a transfer-fixing nip in one example of the related-art image forming apparatus.

As illustrated in FIG. 1, after the solid toner image contacts the transfer material, the whole image may be transferred and fixed to the transfer material. Since the solid toner image has a continuous film-like shape, even when a part of the toner image does not contact the transfer material, the whole image may be successfully transferred and fixed to the transfer material.

FIGS. 2 and 3 illustrate a transfer-fixing process in which a dotted toner image is transferred and fixed to a transfer material. As illustrated in FIG. 2, when the toner image includes dots separated from each other, some dots fail to contact the transfer material and thus remain on the image carrier without being transferred to the transfer material, thereby causing an image defect. As illustrated in FIG. 3, even when the image carrier has a decreased hardness in order to conform more readily to the irregularities in a surface of the transfer material and the transfer material contacts the image carrier with an increased pressure, some dots still fail to contact the transfer material and remain on the image carrier. Thus, a complete image may not be transferred and fixed to the transfer material.

In such a transfer-fixing method, a sticking force of the toner particles causes the toner image carried by the image carrier to be transferred to the transfer material. Thus, if the toner particles fail to contact the transfer material, the toner image may not be transferred to the transfer material, thereby causing an image defect.

Additionally, such residual toner remaining on the image carrier may change from a liquid state to a solid state after passing through the transfer-fixing nip and may be fixed to the surface of the image carrier. Alternatively, the residual toner may adhere to other components contacting the image carrier or stick to other transfer material. As a result, wasted toner may cause environmental burdens, or may shorten a lifetime of a toner removal device.

BRIEF SUMMARY OF THE INVENTION

The concept of the present invention is to provide an image forming apparatus including a transfer-fixing device for transferring and fixing a toner image to a transfer material without generating an image defect by using a transfer-fixing method including both heat transfer and electrostatic transfer. In other words, the idea is to use heat transfer to obtain the benefits of the transfer-fixing method while using electrostatic transfer to remedy the image defects that can be a disadvantage of the transfer-fixing method.

This specification describes a transfer-fixing device according to exemplary embodiments of the present invention. In one exemplary embodiment of the present invention, the transfer-fixing device transfers a toner image to a transfer material and fixes the toner image on the transfer material, and includes an image carrier, a pressing member, a heater, and an electrical field generator. The image carrier is configured to carry the toner image. The pressing member is configured to press against the image carrier to form a transfer-fixing nip between the pressing member and the image carrier. The heater is configured to heat the toner image carried by the image carrier so that a temperature of the toner image is not higher than Tm +10 degrees centigrade when a toner softening point is Tm degrees centigrade. The electrical field generator is configured to form a transfer electrical field at the transfer-fixing nip.

This specification further describes an image forming apparatus according to exemplary embodiments of the present invention. In one exemplary embodiment of the present invention, the image forming apparatus includes a transfer-fixing device. The transfer-fixing device transfers a toner image to a transfer material and fixes the toner image on the transfer material, and includes an image carrier, a pressing member, a heater, and an electrical field generator as described above.

This specification further describes a transfer-fixing method according to exemplary embodiments of the present invention. In one exemplary embodiment of the present invention, the transfer-fixing method includes carrying a toner image with an image carrier, pressing a pressing member against the image carrier to form a transfer-fixing nip between the pressing member and the image carrier, heating the toner image carried by the image carrier so that a temperature of the toner image is not higher than Tm +10 degrees centigrade when a toner softening point is Tm degrees centigrade, forming a transfer electrical field at the transfer-fixing nip, and simultaneously transferring and fixing the toner image carried by the image carrier to a transfer material.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
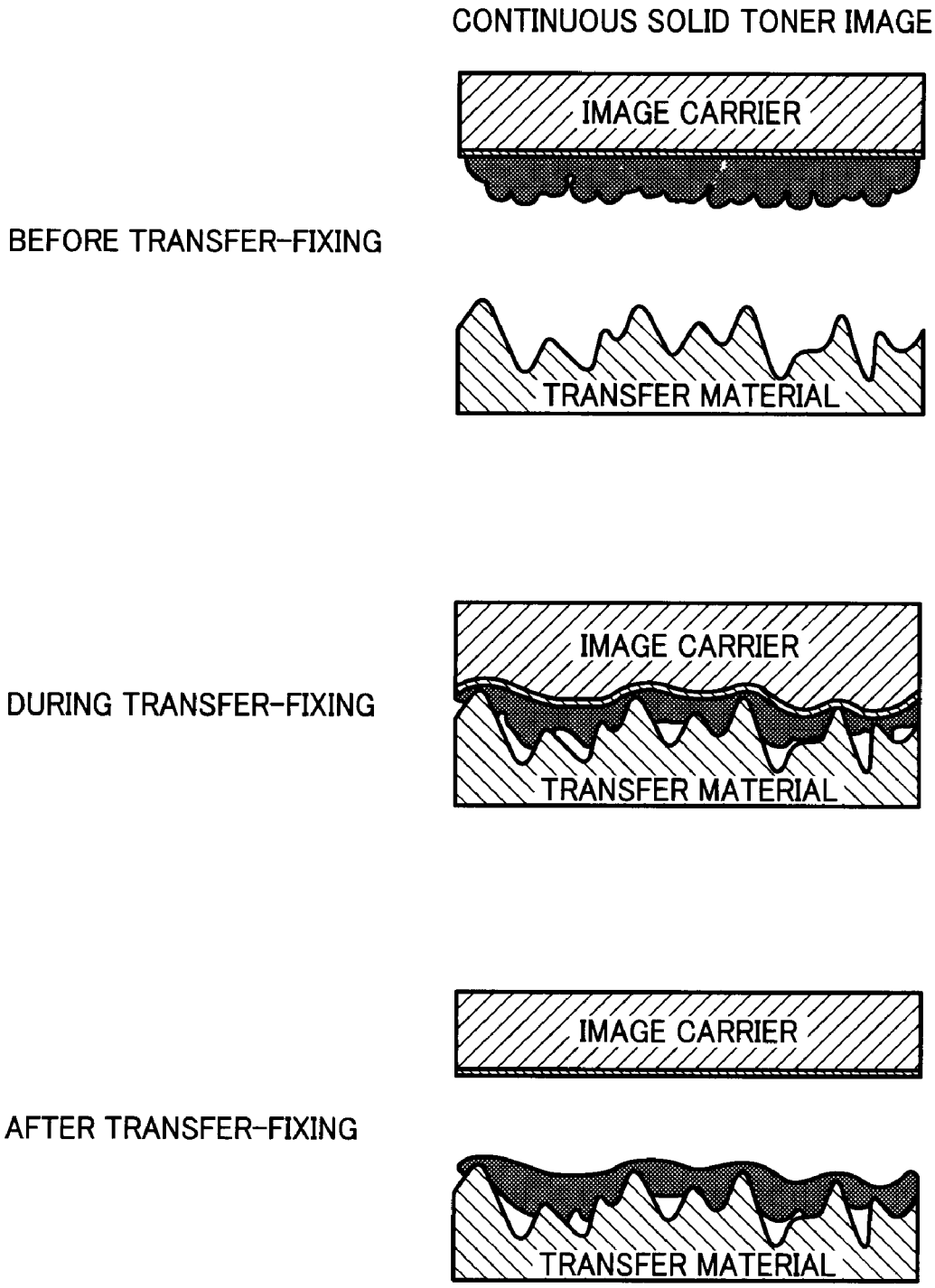
FIG. 1 RELATED ART
FIG. 1 illustrates a related-art transfer-fixing process in which a solid toner image is transferred from an image carrier to a transfer material and fixed to the transfer material.
Figure 2:
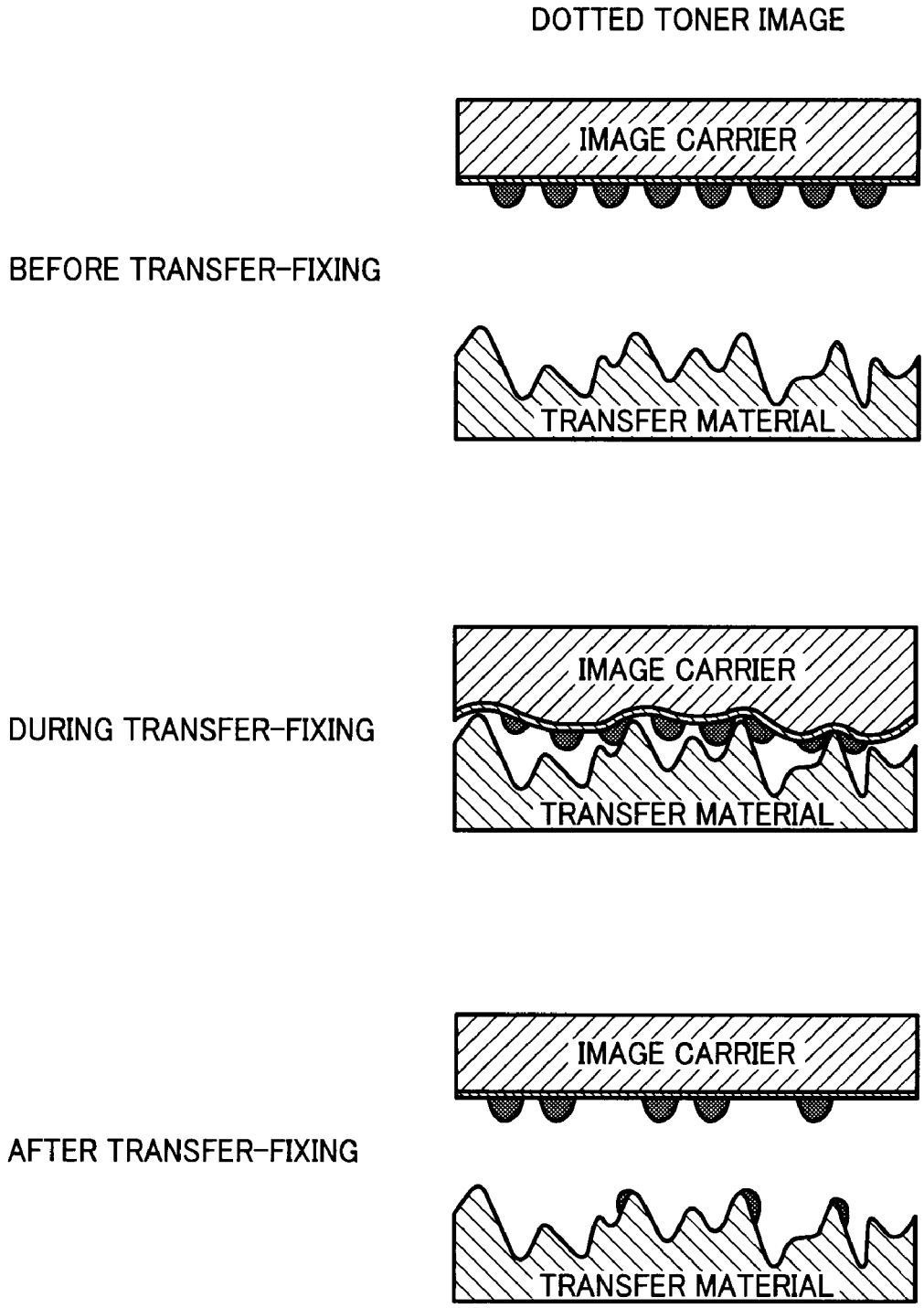
FIG. 2 RELATED ART
FIG. 2 illustrates another related-art transfer-fixing process in which a dotted toner image is transferred from an image carrier to a transfer material and fixed to the transfer material.
Figure 3:
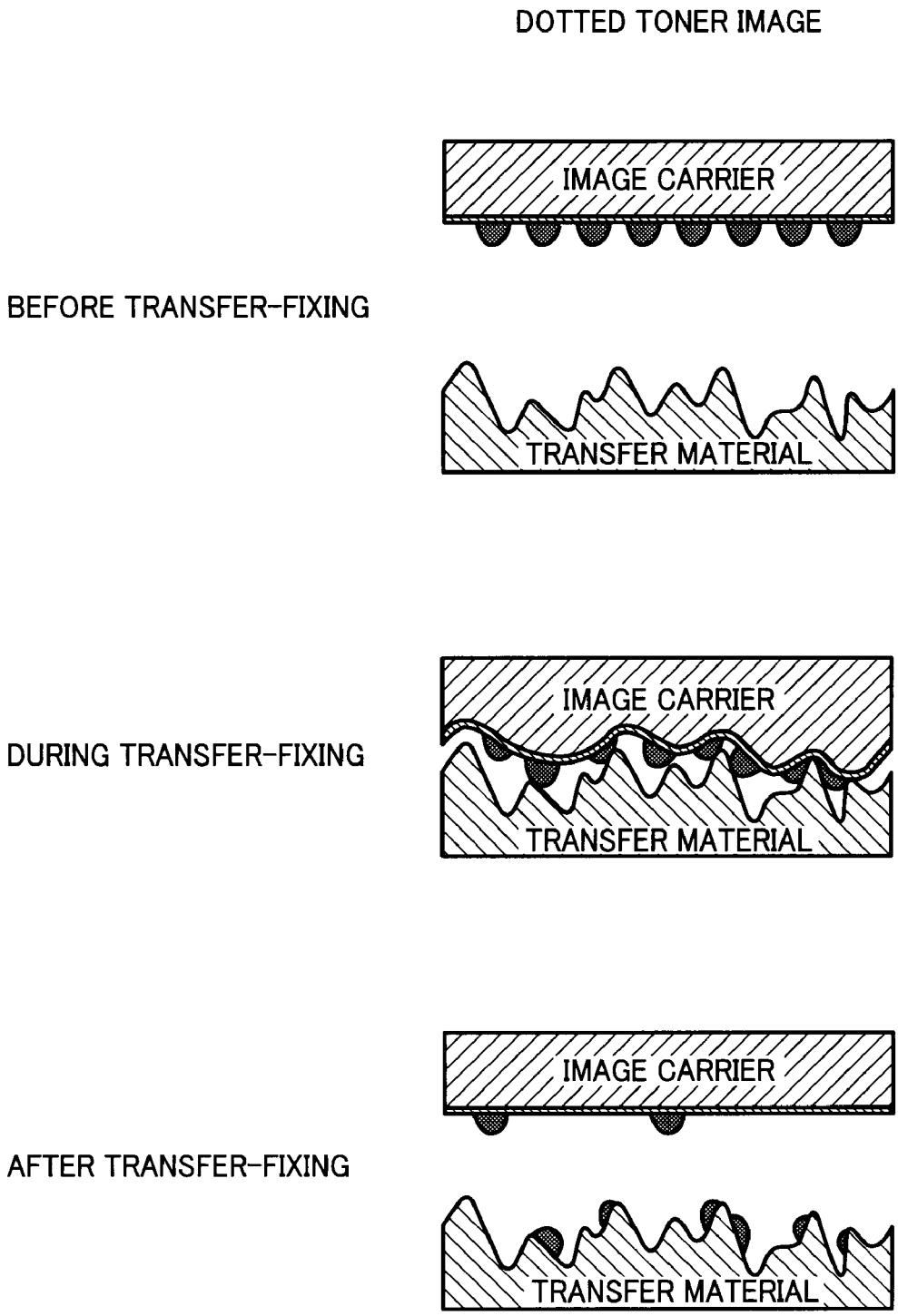
FIG. 3 RELATED ART
FIG. 3 illustrates yet another related-art transfer-fixing process in which a dotted toner image is transferred from an image carrier with a decreased hardness to a transfer material contacting the image carrier with an increased pressure and fixed to the transfer material.

In describing exemplary embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Figure 4:
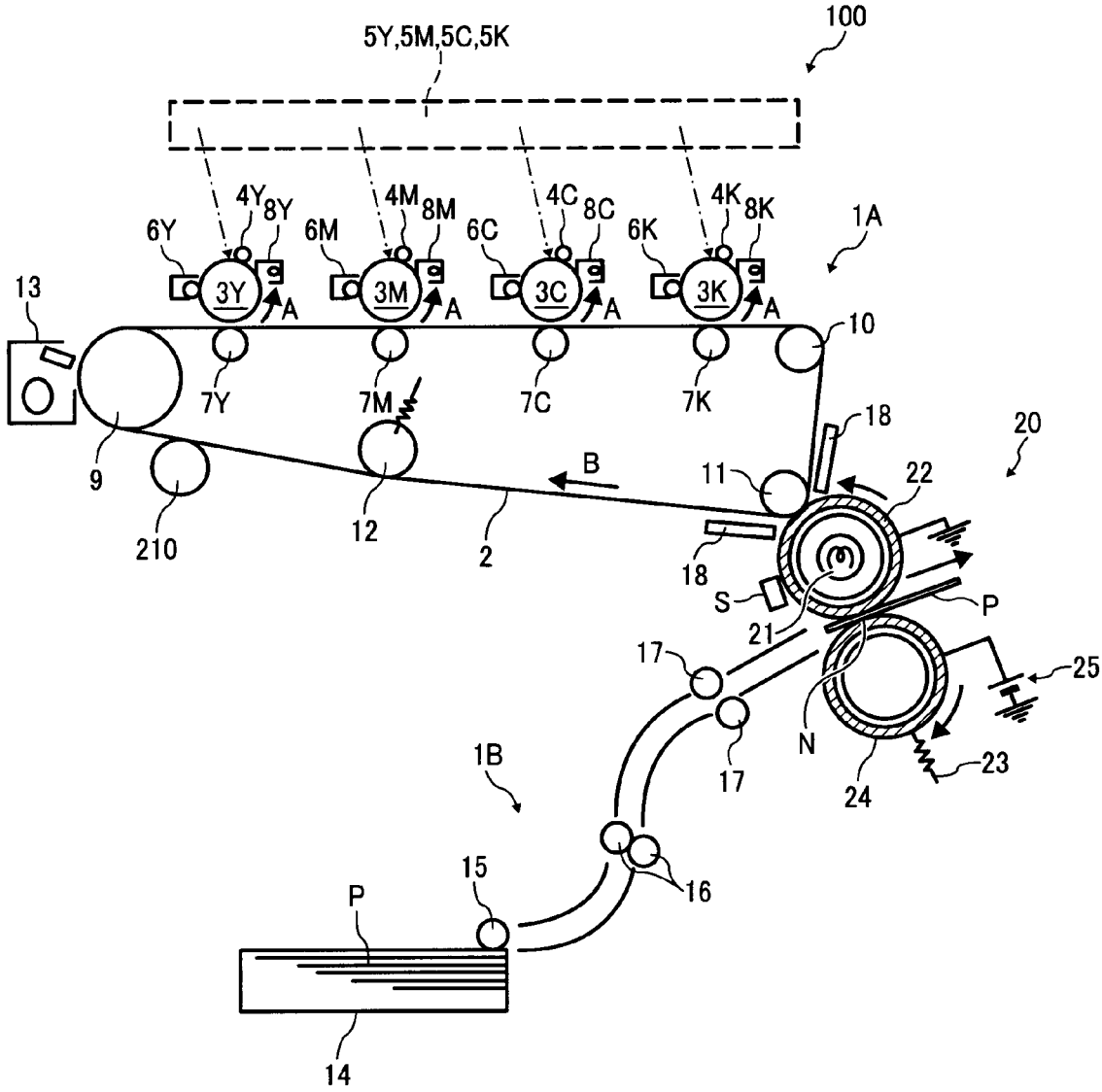
FIG. 4 is a schematic view of a tandem type image forming apparatus according to an exemplary embodiment of the present invention.

Referring now to the drawings, wherein like reference numerals designate identical or corresponding parts throughout the several views, in particular to FIG. 4, an image forming apparatus 100 according to an exemplary embodiment of the present invention is described.

The image forming apparatus 100 includes an image forming device 1A and a feeding device 1B. The image forming device 1A includes an intermediate transfer belt 2, photoconductors 3Y, 3M, 3C, and 3K, chargers 4Y, 4M, 4C, and 4K, writers 5Y, 5M, 5C, and 5K, development devices 6Y, 6M, 6C, and 6K, primary transfer devices 7Y, 7M, 7C, and 7K, cleaning devices 8Y, 8M, 8C, and 8K, a driving roller 9, driven rollers 10, 11, and 12, a cleaner 13, a transfer-fixing device 20, heat insulating plates 18, and a cooling roller 210. The transfer-fixing device 20 includes a transfer-fixing roller 22, a pressing roller 24, a pressure member 23, a temperature sensor S, and an electrical field generator 25. The transfer-fixing roller 22 includes a halogen heater 21. The feeding device 1B includes a paper tray 14, a feed roller 15, a conveyance roller pair 16, and a registration roller pair 17.

The image forming apparatus 100 may be a copier, a facsimile machine, a printer, a multifunction printer having two or more of copying, printing, scanning, and facsimile functions, or the like. According to this non-limiting example embodiment, the image forming apparatus 100 functions as a tandem type color copier for forming a color image on a recording medium (e.g., a sheet) by electrophotography. However, the image forming apparatus 100 is not limited to the color copier and may form a color and/or monochrome image in other configurations.

The image forming device 1A is provided in a center portion of the image forming apparatus 100. The feeding device 1B is provided below the image forming device 1A. An image reader (not shown) is provided above the image forming device 1A. The intermediate transfer belt 2, serving as an intermediate transfer member, includes a transfer surface extending horizontally. The photoconductors 3Y, 3M, 3C, and 3K are provided side by side above and along the transfer surface of the intermediate transfer belt 2, and carry a toner image in yellow, magenta, cyan, and black, respectively.

Each of the photoconductors 3Y, 3M, 3C, and 3K has a drum-like shape and may rotate in a direction A (e.g., counterclockwise). Around the photoconductors 3Y, 3M, 3C, and 3K are provided the chargers 4Y, 4M, 4C, and 4K, the writers 5Y, 5M, 5C, and 5K as optical writers, the development devices 6Y, 6M, 6C, and 6K, the primary transfer devices 7Y, 7M, 7C, and 7K, and the cleaning devices 8Y, 8M, 8C, and 8K, all of which perform image forming processing in a process of rotation of the photoconductors 3Y, 3M, 3C, and 3K, respectively. "Y", "M", "C", and "K" applied to each reference numeral of the above devices correspond to yellow, magenta, cyan, and black toner, respectively. The development devices 6Y, 6M, 6C, and 6K store toner in respective colors. The intermediate transfer belt 2 is looped over the driving roller 9 and the driven rollers 10, 11, and 12, and may move in a direction B. The cleaner 13 opposes the driving roller 9 and cleans the surface of the intermediate transfer belt 2.

When the photoconductors 3Y, 3M, 3C, and 3K rotate, the intermediate transfer belt 2 moves. The charger 4Y evenly charges a surface of the photoconductor 3Y and the writer 5Y performs writing based on image information transmitted from the image reader to form an electrostatic latent image on the photoconductor 3Y. The electrostatic latent image is made visible as a toner image by the development device 6Y, which stores yellow toner. The primary transfer device 7Y is applied with a predetermined bias and transfers the toner image on the intermediate transfer belt 2. Similarly, magenta, cyan, and black toner images are formed on the photoconductors 3M, 3C, and 3K, respectively, and transferred and superimposed in this order onto the intermediate transfer belt 2.

After this primary transfer of the toner images, the cleaning devices 8Y, 8M, 8C, and 8K remove residual toner remaining on the photoconductors 3Y, 3M, 3C, and 3K. Also, a discharge lamp (not shown) resets electrical potentials of the photoconductors 3Y, 3M, 3C, and 3K, so as to prepare for a subsequent imaging process.

The transfer-fixing device 20 is provided in the vicinity of the driven roller 11. A toner image carried by the intermediate transfer belt 2 is transferred to the transfer-fixing roller 22 of the transfer-fixing device 20. The pressure member 23 presses the pressing roller 24, serving as a pressing member, against the transfer-fixing roller 22 to form a transfer-fixing nip N therebetween. The pressing roller 24 may be a non-rotating pressing member. The transfer-fixing roller 22 is pipe-shaped and made of aluminum or other metal, with a surface thereof coated with a releasing layer. The halogen heater 21, serving as a heater, is provided inside the transfer-fixing roller 22 and heats the toner image on the transfer-fixing roller 22.

The paper tray 14 of the feeding device 1B stores a sheet P (e.g., a transfer material). The feed roller 15 separates an uppermost sheet P from other sheet P loaded on the paper tray 14 and feeds the sheet P toward the conveyance roller pair 16. The conveyance roller pair 16 conveys the sheet P fed by the feed roller 15 toward the registration roller pair 17. The registration roller pair 17 temporarily stops the sheet P to correct a conveyance direction of the sheet P (e.g., an oblique misalignment), and sends the sheet P toward the transfer-fixing nip N when a leading edge of the toner image on the transfer-fixing roller 22 reaches a predetermined position on the sheet P in the conveyance direction of the sheet P.

Therefore, after the toner image is transferred from the photoconductors 3Y, 3M, 3C, and 3K to the intermediate transfer belt 2, the toner image is electrostatically transferred (secondary transfer) to the transfer-fixing roller 22 by a bias applicator (not shown) applying a bias, such as an alternating current, a superimposed pulse, or the like, to the driven roller 11.

The heat insulating plates 18 are provided between the intermediate transfer belt 2 and the transfer-fixing roller 22, and prevent heat emission (e.g., heat transfer) from the transfer-fixing roller 22 to the intermediate transfer belt 2. The heat insulating plates 18 include an opening portion in order to prevent heat emission to the intermediate transfer belt 2, so as not to disturb the secondary transfer of the toner image from the intermediate transfer belt 2 to the transfer-fixing roller 22. The heat insulating plates 18 may be provided either in a fixing device (not shown) or in the image forming apparatus 100. The heat insulating plates 18 may include a plate-like material having a metallic luster with low emissivity. In particular, provision of two pieces of metal sheets sandwiching a minute space or a heat insulating material may obtain an improved effect. Alternatively, use of a thin plate including a micro heat pipe structure used for cooling a CPU of a notebook computer may maintain a low temperature of the heat insulating plates 18, thereby preventing heat transfer.

The cooling roller 210 is provided between a transfer portion where the intermediate transfer belt 2 opposes the transfer-fixing roller 22 and a transfer portion where the intermediate transfer belt 2 opposes the photoconductor 3Y provided in the extreme upstream side in a direction of movement of the intermediate transfer belt 2, and draws heat from the intermediate transfer belt 2. The cooling roller 210 includes a material with a high degree of heat conductivity and rotates while contacting the intermediate transfer belt 2. According to this exemplary embodiment, the image forming device 1A of the image forming apparatus 100 includes both the heat insulating plates 18 and the cooling roller 210, although either one of them will suffice. According to this exemplary embodiment, a temperature of the intermediate transfer belt 2 may be decreased, heat deterioration of the intermediate transfer belt 2 may be prevented, and design flexibility of the intermediate transfer belt 2 may be increased.

After the toner image is transferred from the intermediate transfer belt 2 to the transfer-fixing roller 22, the toner image is heated on the transfer-fixing roller 22 before being fixed to the sheet P at the transfer-fixing nip N. Since the toner image is sufficiently heated in advance, the toner image may be heated at a lower temperature than in a conventional method in which the toner image and the sheet P are heated at the same time.

The temperature sensor S may be either a contact-type or a noncontact-type, and detects a temperature of the transfer-fixing roller 22 at an outer circumferential position of the transfer-fixing roller 22 upstream from the transfer-fixing nip N at which the toner image is transferred and fixed to the sheet P in a direction of rotation of the transfer-fixing roller 22.

Figure 5:
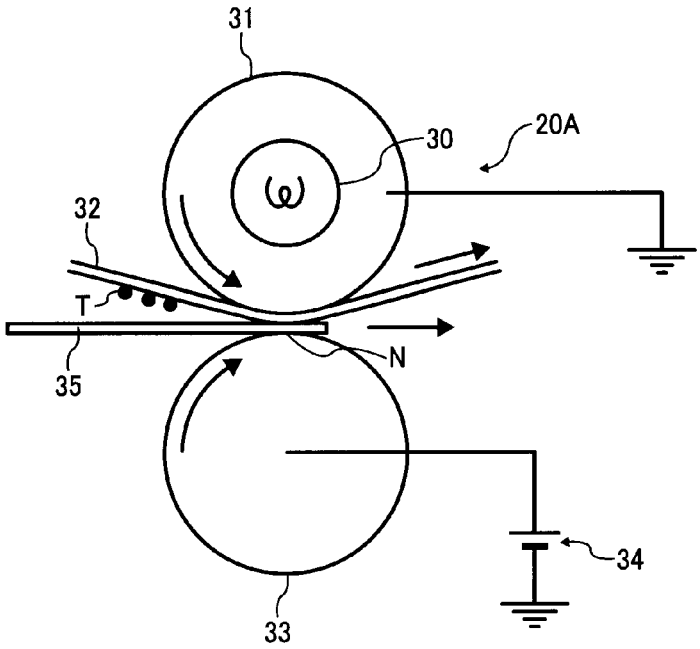
FIG. 5 is a sectional view of an experimental transfer-fixing device.
Figure 6:
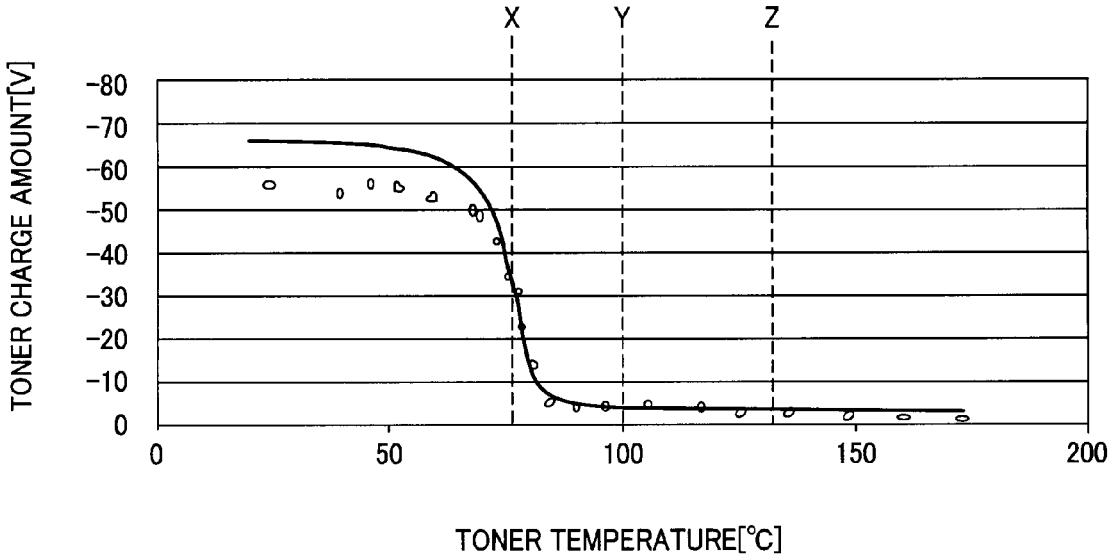
FIG. 6 is a graph illustrating a relation between toner temperature and toner charge amount in the transfer-fixing device shown in FIG. 5.

Accordingly, referring to FIGS. 5 and 6, the following describes an experiment performed by using a transfer-fixing device 20A in order to examine actual effects of the transfer-fixing method.

FIG. 5 illustrates the transfer-fixing device 20A in an image forming apparatus using the transfer-fixing method. The transfer-fixing device 20A includes a stretching roller 31, an image carrier 32, a pressing member 33, and an electrical field generator 34. The stretching roller 31 includes a heater 30.

The image carrier 32 has a belt-like shape and is looped over the stretching roller 31. The heater 30 is provided in the stretching roller 31 and heats the image carrier 32 via the stretching roller 31. The pressing member 33 has a roller-like shape and presses against the stretching roller 31 via the image carrier 32 to form a transfer-fixing nip N at which the electrical field generator 34 forms a transfer electrical field. When a transfer material 35 passes through the transfer-fixing nip N, a toner image T carried by the image carrier 32 is transferred and fixed to the transfer material 35.

Experimental conditions for the transfer-fixing device 20A were as follows.

Image carrier: a belt member including three layers:
- a basic layer including a polyimide resin with a thickness of 70 μm;
- an elastic layer including a silicon rubber with a thickness of 500 μm; and
- a surface layer including a PTFE (polytetrafluoroethylene) with a thickness of 10 μm Pressing member: a roller member using a metal roller with a diameter of Φ40 mm as a core metal.

Toner: polyester resin-based toner

Charge amount of toner: from −10 μC/mg to −50 μC/mg

Heat characteristics of toner:
- softening point: 75 degrees centigrade;
- melting start temperature: 100 degrees centigrade; and
- ½ melting temperature: 130 degrees centigrade Heater: a halogen heater (e.g., the heater 30) provided in the stretching roller 31 opposing the pressing member 33

Heating temperature: 170 degrees centigrade at an entrance of the transfer-fixing nip N Transfer material: plain paper of about 80 g/cm$^3$ Transfer electrical field applier:
- bias voltage of from +0.5 kV to +4.0 kV applied to the pressing member 33; and
- the grounded stretching roller 31

Chart: 2 by 2 dot image (600 dpi)

The heat characteristics is also referred to as a flow tester characteristics, and was measured from a flow curve when a toner sample of 1 cm$^3$ was melted under conditions of a diameter of a pore of a die of 1 mm, a pressure of 20 kg/cm$^2$, and a temperature increase speed of 6 degrees centigrade/ min. using an elevated flow tester CFT-500 manufactured by SHIMADZU CORPORATION.

A thermocouple (not shown) contacts a surface of the image carrier 32 immediately before the surface of the image carrier passes through the transfer-fixing nip N. A heating temperature was controlled based on temperature information provided by the thermocouple. A test performed by using a noncontact thermography confirmed that a temperature of the image carrier 32 measured by the thermocouple was almost equal to a temperature of a toner layer. Therefore, the test revealed that the transfer-fixing device 20A might control a temperature of toner forming the toner image T passing through the transfer-fixing nip N.

Under the above conditions, a transfer electrical field was formed when the toner image T carried by the image carrier 32 was transferred and fixed to the transfer material 35. However, there was no improvement in the image defect.

An additional experiment was performed under different heating temperatures and transfer voltages in order to find a cause of the above result, and revealed that the image defect was improved at low heating temperatures, and that the toner charge amount varied according to the heating temperature. FIG. 6 illustrates variations in the toner charge amount in the experiment. "X" represents a softening point of toner, "Y" represents a melting start temperature, and "Z" represents a ½ melting temperature. The toner charge amount was confirmed by the following method.

Since a method of measuring the toner charge amount by a Faraday cage may not be used when toner is in a heated condition, a heat resistance surface potential electrometer probe read a charge amount of a toner layer as an alternative characteristic. However, when surface potential is used as a characteristic value, a change in a dielectric constant due to heating needs to be considered. Therefore, after the charge amount of heated toner was measured, the toner was naturally cooled and the charge amount was measured again to confirm that measured values of the heated toner and the cooled toner did not differ from each other, that is, the measured value of the toner charge amount while being heated substituted for the variation of the toner charge amount.

The result shows that the toner charge amount tends to decrease at around the softening point of toner, and almost disappears at around the softening point +10 degrees centigrade. Also, another toner having a different softening point had an almost equivalent tendency. Therefore, since the toner charge amount decreases when the toner is heated at a higher temperature, it is assumed that the defective image was not improved due to insufficient force of electrostatic transfer, which corresponds to F=qE, in which "F" represents the force of electrostatic transfer, "q" represents the toner charge amount and "E" represents the transfer electrical field.

When occurrences of image defects at different heating temperatures were examined, the results obtained verified the above assumption. Table 1 indicates that the defective image was not improved when the heating temperature was at 170 degrees centigrade and at 130 degrees centigrade, but that the number of image defects per ten dots decreased to about two dots or less by application of a sufficient electrical field at 85 degrees centigrade (e.g., the softening point +10 degrees centigrade), and no image defects were generated at 75 degrees centigrade, which is not higher than the softening point.

TABLE 1

| | Heating temperature | | | |
|---|---|---|---|---|
| Applied voltage | 170 degrees centigrade | 130 degrees centigrade | 85 degrees centigrade | 75 degrees centigrade |
| 0.5 kV | X | X | X | ○ |
| 1.0 kV | X | X | Δ | ○ |
| 2.0 kV | X | X | Δ | ○ |
| 4.0 kV | X | X | Δ | ○ |

In the above table 1, ○ represents no image defects per ten dots, Δ represents image defects in two dots or less per ten dots, and × represents image defects in three dots or more per ten dots.

Accordingly, in order to use the transfer-fixing method to combine heating the toner layer and the electrostatic transfer method, the toner needs to be transferred and fixed at a temperature at which the charge of the toner does not disappear, that is, when the temperature of the toner is at least lower than the toner softening point +10 degrees centigrade, preferably not higher than the toner softening point.

Specifically, as illustrated in FIG. 4 and noted above, the transfer-fixing device 20 includes the transfer-fixing roller 22 serving as an image carrier, the pressing roller 24 serving as a pressing member, for pressing against the image carrier to form a transfer-fixing nip N, the halogen heater 21 serving as a heater, for heating a toner image carried by the image carrier, and the electrical field generator 25 for forming a transfer electrical field at the transfer-fixing nip. After the halogen heater 21 heats the toner image carried by the transfer-fixing roller 22, the toner image is transferred and fixed to a sheet P passing through the transfer-fixing nip N. When a toner softening point is Tm degrees centigrade, the halogen heater 21 heats the toner image carried by the transfer-fixing roller 22 such that a temperature of the toner image is not higher than Tm +10 degrees centigrade. As a result, a decrease of the toner charge amount due to heating of the halogen heater 21 may be prevented. Accordingly, insufficient force of electrostatic transfer may be prevented.

However, insufficient toner fixation occurred when the temperature of the toner was not higher than the softening point, especially in an experiment for forming a color image to which a great amount of toner was adhered. Thus, an additional heater may be preferably provided.

Figure 7:
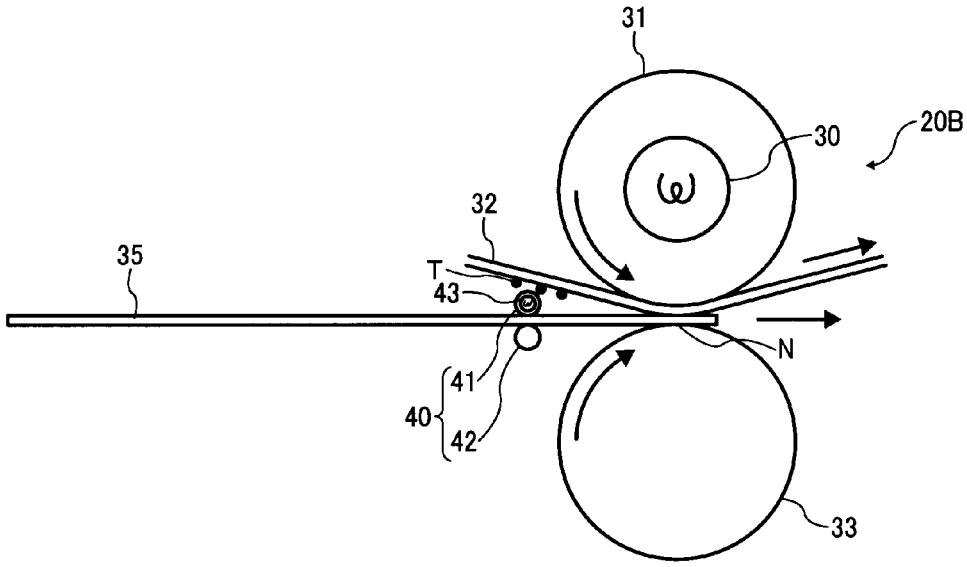
FIG. 7 is a sectional view of a transfer-fixing device according to another exemplary embodiment of the present invention.

FIG. 7 illustrates a transfer-fixing device 20B according to another exemplary embodiment. The transfer-fixing device 20B includes a preheater 40. The preheater 40 includes a registration roller pair 41 and 42. The registration roller 41 includes a halogen heater 43. The other elements of the transfer-fixing device 20B are common to the transfer-fixing device 20A depicted in FIG. 5

The preheater 40, serving as an additional heater, preheats a transfer material 35 before the transfer material 35 passes through the transfer-fixing nip N. A toner image T carried by the image carrier 32 is transferred and fixed to the preheated transfer material 35 passing through the transfer-fixing nip N. Therefore, the transfer material 35 is preheated immediately before entering the transfer-fixing nip N, so that the toner image T may be more sufficiently fixed to the transfer material 35 by heat applied by the preheater 40 in addition to heat applied by the heater 30.

Also, the preheater 40 may function as a conveyer for conveying the transfer material 35. For example, as illustrated in FIG. 7, the preheater 40 may include the registration roller pair 41 and 42. Thus, while the preheater 40 preheats the transfer material 35, the preheater 40 conveys the transfer material 35 and passes the transfer material 35 through the transfer-fixing nip N. Accordingly, the toner image T may be more properly fixed to the transfer material 35 without adding a new component as a preheater and providing an additional installation space for the component in addition to the conveyer.

As illustrated in FIG. 7, one of the registration roller pair 41 and 42, that is, the registration roller 41 contacting a surface of the transfer material 35 to which the toner image T is transferred, functions as a heating roller. According to this exemplary embodiment, the registration roller 41 includes a roller with an outer diameter of about 20 mm in which an aluminum core metal is coated by silicon rubber and the halogen heater 43 incorporated in the roller, so as to heat paper (e.g., the transfer material 35). The registration roller 42 functions as a pressing roller. When the registration roller 42 presses the transfer material 35 against the registration roller 41 to nip and convey the transfer material 35, the registration roller 41 heats the transfer material 35 by controlling the halogen heater 43, thereby maintaining a temperature of the transfer material 35 immediately after passing through the registration roller pair 41 and 42 in a range of from room temperature to about 170 degrees centigrade.

However, the temperature of the transfer material 35 starts decreasing due to ambient temperature immediately after passing through the registration roller pair 41 and 42, and about 0.5 seconds later decreases by about 10 degrees centigrade to about 20 degrees centigrade. Thus, the registration roller pair 41 and 42 is preferably provided near the transfer-fixing nip N. Moreover, by enclosing a space between the registration roller pair 41 and 42 and the transfer-fixing nip N so as to maintain the ambient temperature to be higher than a room temperature, the decrease in the temperature of the transfer material 35 after passing through the registration roller pair 41 and 42 may be prevented or reduced.

Accordingly, by using a toner image T having the charging characteristics as shown in FIG. 6, when the registration roller pair 41 and 42 heats the transfer material 35 to from about 80 degrees centigrade to about 150 degrees centigrade, the toner image T may be properly transferred and fixed even at a softening point +10 degrees centigrade as a temperature of the transfer-fixing nip N. Therefore, the transfer-fixing device 20 depicted in FIG. 4 also may preferably include the preheater 40 for preheating a sheet P before the sheet P passes through the transfer-fixing nip N. Further, the preheater 40 also may function as a conveyer for conveying the sheet P.

Figure 8:
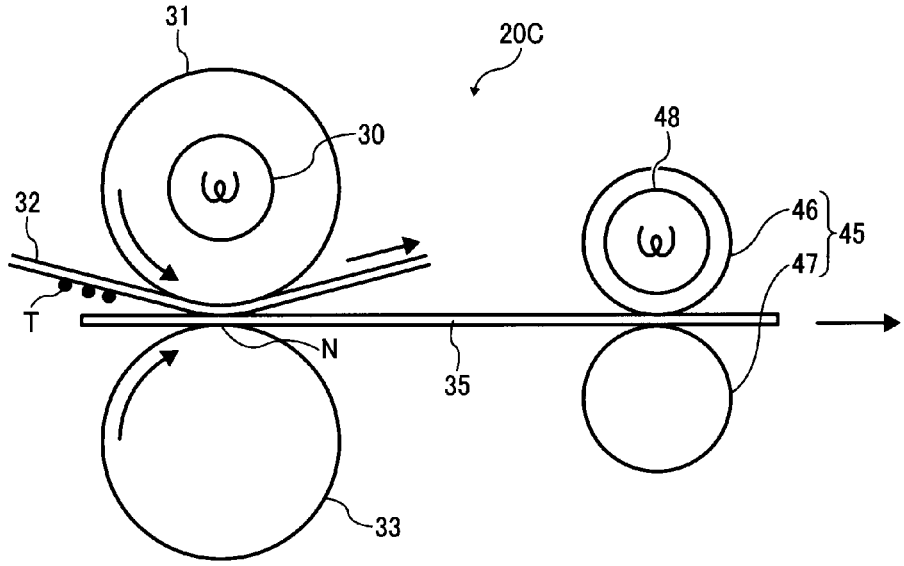
FIG. 8 is a sectional view of a transfer-fixing device according to yet another exemplary embodiment.

FIG. 8 illustrates a transfer-fixing device 20C according to yet another exemplary embodiment. The transfer-fixing device 20C includes a supplementary heater 45. The supplementary heater 45 includes a fixing roller 46 and a pressing roller 47. The fixing roller 46 includes a heater 48. The other elements of the transfer-fixing device 20C are common to the transfer-fixing device 20A depicted in FIG. 5.

After a transfer material 35 passes through the transfer-fixing nip N, the supplementary heater 45 heats the toner image T transferred and fixed on the transfer material 35. Accordingly, after passing through the transfer-fixing nip N, the transfer material 35 is again heated for fixation, and thereby the toner image T may be firmly fixed to the transfer material 35.

According to this exemplary embodiment, the fixing roller 46 includes a stainless core metal with a diameter of about 15 mm covered by a foamed silicon rubber layer with a thickness of about 10 mm and a surface layer of a PFA (tetrafluoroethylene-perfluoroalkyl vinyl ether copolymer) tube with a thickness of about 20 μm. The pressing roller 47 includes a stainless steel core metal with a diameter of about 26 mm covered by a silicon rubber layer with a thickness of about 2 mm and a surface layer of PFA tube with a thickness of about 20 μm. That is, a structure of the supplementary heater 45 may be identical to that of a fixing device generally provided. According to this exemplary embodiment, the heater 48 heats the fixing roller 46 to a temperature ranging from about 100 degrees centigrade to about 200 degrees centigrade. By pressing and heating the transfer material 35 bearing the toner image T having the charging characteristics as shown in FIG. 6 while the transfer material 35 passes between the fixing roller 46 and the pressing roller 47, the toner image T may be firmly and properly fixed on the transfer material 35.

The preheater 40 depicted in FIG. 7 and the supplementary heater 45 depicted in FIG. 8 may have not a roller-like shape but a sheet-like shape. Alternatively, the preheater 40 and the supplementary heater 45 may use radiant heat without contacting the transfer material 35. Therefore, the transfer-fixing device 20 depicted in FIG. 4 also may include the supplementary heater 45 for heating a toner image transferred and fixed to a sheet P after the sheet P passes through the transfer-fixing nip N.

The experimental result obtained by using the transfer-fixing device 20A depicted in FIG. 5 may be applied to a transfer-fixing device using an intermediate transfer member as an image carrier, a transfer-fixing device (e.g., the transfer-fixing device 20 depicted in FIG. 4) using a transfer-fixing member (e.g., the transfer-fixing roller 22 depicted in FIG. 4) as an image carrier, or a transfer-fixing device using a photoconductor as an image carrier, thereby obtaining equivalent effect. Also, as illustrated in FIG. 5, the transfer-fixing device 20A uses the heater 30 (e.g., a halogen heater) incorporated in the stretching roller 31 as a heater for heating the toner image T, however, radiant heat may be used to apply heat to the surface of the image carrier 32, or an IH (induction heating) method may be used as a heat source; thereby obtaining an equivalent effect.

The above exemplary embodiments show one example of a transfer-fixing member, e.g., the transfer-fixing roller 22 depicted in FIG. 1 and the stretching roller 31 depicted in FIGS. 5, 7, and 8. However, the transfer-fixing member may be selected from perfluoro resins with a great releasing property including PTFE (polytetrafluoroethylene), PFA (tetrafluoroethylene-perfluoroalkyl vinyl ether copolymer), and FEP (fluorinated-ethylene propylene). Less than several percent of a filling material such as carbon may be included in the above resins in order to obtain electrical conductivity and abrasion resistance. The releasing property may be represented by a contact angle of water. The contact angle is correlated with surface energy. That is, the smaller the surface energy is, the larger the contact angle becomes. Materials thereof have small surface energy indicating a contact angle of from about 110° to about 125°.

Examples of a binder resin used for toner may include the following components satisfying toner characteristics, such as homopolymers of styrene and styrene substitution (e.g., polyester, polystyrene, poly-p-chlorostyrene, and polyvinyl toluene), and styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chlormethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer).

Mixtures of resins (e.g., polymethyl methacrylate, polybutyl methacrylate, polyvinyl chloride, polyvinyl acetate, polyethylene, polypropylene, polyurethane, polyamide, epoxide resin, polyvinyl butyral, polyacrylic acid resin, rosin, modified rosin, terpene resin, phenol resin, aliphatic or alicyclic hydrocarbon resin, aromatic system petroleum resin, chlorinated paraffin, and paraffin wax) may be used. In particular, polyester resin may be preferably included in a binder resin since polyester resin may provide a sufficient fixing property. The polyester resin may be obtained from condensation polymerization between an alcohol and a carboxylic acid. Examples of the alcohol may include diols (e.g., polyethylene glycol, diethylene glycol, triethylene glycol, 1,2-propylene glycol, 1,3-propylene glycol, 1,4-butanediol, neopentyl glycol, and 1,4-butenediol), etherified bisphenols (e.g., 1,4-bis (hydroxymethyl)cyclohexane, bisphenol A, hydrogenated bisphenol A, polyoxyethylenated bisphenol A, and polyoxypropylenated bisphenol A), dihydric alcohols obtained by substituting the above with a saturated or an unsaturated hydrocarbon group having 3 to 22 carbon atoms, and other dihydric alcohols.

In order to obtain the polyester resin used as a binder resin, polymers including polyfunctional monomers having not less than three functions may be used as well as the above polymers containing bifunctional monomers. Examples of the polyalcohol monomer having three or more valences may include sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a polycarboxylic acid monomer having three or more valences may include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, trimetric acid, and acid anhydrides thereof.

In order to improve toner releasing property on the surface of the transfer-fixing member (e.g., the transfer-fixing roller 22 depicted in FIG. 1 and the stretching roller 31 depicted in FIGS. 5, 7, and 8) at the time of transferring and fixing a toner image, the toner used in the above-described exemplary embodiments may include a release agent. Known release agents may be used, and especially free fatty acid type carnauba wax, montan wax, oxidized rice wax, and ester wax may be used alone or in combination. The carnauba wax may have a microcrystal structure, an acid value of not greater than about 5 mgKOH/g, and a particle diameter of not greater than about 1 μm when dispersed in a toner binder. The montan wax generally refers to a purified mineral wax, and also may have a microcrystal structure like the carnauba wax and an acid value ranging from about 5 mgKOH/g to about 14 mgKOH/g. The oxidized rice wax is obtained by oxidizing a rice bran wax with air, and may have an acid value ranging from about 10 mgKOH/g to about 30 mgKOH/g. When each of the acid values of the above waxes does not reach the above range, a temperature of toner fixation increases, causing insufficient low temperature fixation. By contrast, when each of the acid values exceeds the above range, a cold offset temperature increases, also causing insufficient low temperature fixation.

An amount of wax added to the binder resin may be in a range of from about 1 to about 15 parts by weight per 100 parts by weight of the binder resin included in the toner, and preferably from about 3 to about 10 parts by weight. When the amount of wax is less than about 1 parts by weight, there is little releasing effect. Alternatively, when the amount of wax exceeds about 15 parts by weight, the toner particles may adhere to the carriers.

A charge control agent may be included in the binder resin in order to charge toner particles. Known charge control agents may be used. A positive charge control agent may include nigrosine, basic dye, lake pigment of basic dye, and quaternary ammonium salt compound. A negative charge control agent may include a metal salt of monoazo dye, metal complexes of salicylic acid, naphthoic acid, and dicarboxylic acid. The content of the charge control agent is determined depending on species of the binder resin used, presence or absence of an additive agent to be used as needed, and toner manufacturing method (e.g., a dispersion method), and is not particularly limited. However, the content of the charge control agent may range from about 0.01 to about 0.08 parts by weight, preferably from about 0.1 to about 2 parts by weight, per 100 parts by weight of the binder resin included in the toner. When the content of the charge control agent is less than about 0.01 parts by weight, there is little effect on a variation of a charge quantity (Q/M) caused by changes in environmental conditions. When the content of the charge control agent exceeds about 7 parts by weight, a low temperature fixation property may deteriorate.

As a metal complex monoazo dye to be used, a chrome complex monoazo dye, a cobalt complex monoazo dye, and an iron complex monoazo dye may be used alone or in combination. Addition of the above dyes improves rising edge (e.g., a time to saturation) of the charge quantity (Q/M) in a developer. Like the content of the charge control agent, the content of the metal complex monoazo dye is determined by species of the binder resin used, presence or absence of an additive agent to be used as needed, and toner manufacturing method (e.g., a dispersion method), and is not particularly limited. However, the content of the metal complex monoazo dye may range from about 0.1 to about 10 parts by weight, preferably from about 1 to about 7 parts by weight, per 100 parts by weight of the binder resin included in the toner. When the content of the metal complex monoazo dye is less than about 0.1 parts by weight, there is little effect. When the content of the metal complex monoazo dye exceeds about 10 parts by weight, a saturated level of the charge quantity may deteriorate.

A color toner may preferably include a metal salt of salicylic acid derivatives. A transparent or white substance without affecting the tone of the color toner may be added to the color toner as needed, so as to stably charge the toner. For example, the color toner may include, but is not limited to, organic boron salts, fluorine-containing quaternary ammonium salts, and calixarene series compounds.

The toner may further include a magnetic material, and may be used as a magnetic toner. Examples of the magnetic material include, but are not limited to, iron oxides (e.g., magnetite, hematite, and ferrite); metals (e.g., iron, cobalt, and nickel) and alloys thereof with metals such as aluminum, cobalt, copper, lead, magnesium, tin, zinc, antimony, beryllium, bismuth, cadmium, calcium, manganese, selenium, titanium, tungsten, and vanadium; and mixtures thereof. The magnetic material preferably has an average particle diameter of from about 0.1 to about 2 μm. The content of the magnetic material in the toner may range from about 20 to about 200 parts by weight, preferably from about 40 to about 150 parts by weight, per 100 parts by weight of resinous principle.

Known colorants for toner may be used. Examples of black colorants may include carbon black, aniline black, furnace black, and lamp black. Examples of cyan colorants may include phthalocyanine blue, methylene blue, victoria blue, methyl violet, aniline blue, and ultramarine blue. Examples of magenta colorants may include rhodamine 6G lake, C.I.Pigment Red 122, watching red, rose bengal, rhodamine B, and alizarin lake. Examples of yellow colorants may include chrome yellow, benzidine yellow, Hansa yellow, naphthol yellow, molybdenum orange, quinoline yellow, and tartrazine.

In order to improve fluidity of the toner, an external additive may be added to the toner. For example, hydrophobic cilica, titanium oxide, alumina, and the like, may be added. Additionally, fatty acid metallic salts, polyvinylidene fluoride, and the like, may be added as needed.

As illustrated in FIG. 4, according to the above-described exemplary embodiments, when a heater (e.g., the halogen heater 21) heats a toner image carried by an image carrier (e.g., the transfer-fixing roller 22) such that a temperature of the toner image is not higher than Tm +10 degrees centigrade, an electrical field generator (e.g., the electrical field generator 25) forms a transfer electrical field at a transfer-fixing nip (e.g., the transfer-fixing nip N), and a transfer-fixing device (e.g., the transfer-fixing device 20) transfers the toner image carried by the image carrier to a transfer material (e.g., the sheet P) passing through the transfer-fixing nip and fixes the toner image thereto. Therefore, electrostatic transfer may prevent insufficient transfer of a toner image such as a dotted toner image due to nonconformity of a surface of the image carrier with irregularities in a surface of the transfer material, and may prevent residual toner from adhering to the image carrier. Further, since the heater heats the toner image such that a temperature of the toner image is not higher than Tm +10 degrees centigrade, the toner image may be firmly fixed without decreasing a toner charge amount due to heating, thereby preventing insufficient transfer of the toner image.

According to the above-described exemplary embodiments, a preheater (e.g., the preheater 40 depicted in FIG. 7) preheats the transfer material before the transfer material passes through the transfer-fixing nip, and the toner image is transferred from the image carrier to the transfer material passing through the transfer-fixing nip and fixed thereon simultaneously. Therefore, the toner image may be firmly fixed to the transfer material.

Moreover, since the preheater also functions as a conveyer for conveying the transfer material, that is, the preheater conveys and preheats the transfer material while conveying it before the transfer material passes through the transfer-fixing nip, the toner image may be more firmly fixed to the transfer material without adding a component functioning as a preheater or an installation space for the component.

In addition, a supplementary heater (e.g., the supplementary heater 45 depicted in FIG. 8) heats the toner image simultaneously transferred and fixed to the transfer material after the transfer material passes through the transfer-fixing nip. That is, after the toner image is transferred and fixed to the transfer material at the transfer-fixing nip, the toner image is re-heated by the supplementary heater 45. Thus, the toner image may be more firmly fixed to the transfer material.

As illustrated in FIG. 4, according to the above-described exemplary embodiments, after a toner image carried by a photoconductor (e.g., the photoconductors 3Y, 3M, 3C, and 3K) is transferred to an intermediate transfer member (e.g., the intermediate transfer belt 2), the toner image carried by the intermediate transfer member is secondarily transferred to a transfer-fixing member serving as an image carrier. Therefore, provision of the intermediate transfer member may prevent heat generated by the heater for heating the toner image on the transfer-fixing member from transmitting to the photoconductor, thereby preventing deterioration of the photoconductor or toner adhesion to the photoconductor.

As can be appreciated by those skilled in the art, although the present invention has been described above with reference to specific exemplary embodiments the present invention is not limited to the specific embodiments described above, and various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A transfer-fixing device for transferring a toner image to a transfer material and fixing the toner image on the transfer material, the transfer-fixing device comprising:

an image carrier configured to carry the toner image;

a pressing member configured to press against the image carrier to form a transfer-fixing nip between the pressing member and the image carrier;

a heater configured to heat the toner image carried by the image carrier so that a temperature of the toner image is not higher than 75 degrees centigrade, a toner softening point is 75 degrees centigrade, and a toner melting start temperature is 100 degrees centigrade;

an electrical field generator configured to form a transfer electrical field at the transfer-fixing nip; and a registration roller pair configured to send the transfer material to the transfer-fixing nip when a leading edge of the toner image on the image carrier reaches a predetermined position on the transfer material; and a preheater formed in the roller registration pair and configured to preheat the transfer material before the transfer material enters the transfer-fixing nip.

2. The transfer-fixing device according to claim 1, wherein the preheater includes a halogen heater incorporated into a first roller of the roller registration pair.

3. The transfer-fixing device according to claim 2, wherein a first roller of the roller registration pair has an outer diameter of about 20 mm, and an aluminum core metal coated by silicon rubber.

4. The transfer-fixing device according to claim 1, further comprising:

a supplementary heater configured to heat the toner image transferred and fixed to the transfer material after the transfer material passes through the transfer-fixing nip.

5. An image forming apparatus, comprising:

a transfer-fixing device configured to transfer a toner image to a transfer material and fix the toner image on the transfer material, the transfer-fixing device comprising:

an image carrier configured to carry the toner image;

a pressing member configured to press against the image carrier to form a transfer-fixing nip between the pressing member and the image carrier;

a heater configured to heat the toner image carried by the image carrier so that a temperature of the toner image is not higher than 75 degrees centigrade, a toner softening point is 75 degrees centigrade, and a toner melting start temperature is 100 degrees centigrade;

an electrical field generator configured to form a transfer electrical field at the transfer-fixing nip; and a registration roller pair configured to send the transfer material to the transfer-fixing nip when a leading edge of the toner image on the image carrier reaches a predetermined position on the transfer material; and a preheater formed in the roller registration pair and configured to preheat the transfer material before the transfer material enters the transfer-fixing nip.

6. The image forming apparatus according to claim 5, further comprising:

an intermediate transfer member configured to carry the toner image, wherein the image carrier comprises a transfer-fixing member configured to receive the toner image carried by the intermediate transfer member and carry the toner image.

7. A transfer-fixing method, comprising:

carrying a toner image with an image carrier;

pressing a pressing member against the image carrier to form a transfer-fixing nip between the pressing member and the image carrier;

heating the toner image carried by the image carrier so that a temperature of the toner image is not higher than 75 degrees centigrade, a toner softening point is 75 degrees centigrade, and a toner melting start temperature is 100 degrees centigrade;

forming a transfer electrical field at the transfer-fixing nip;

simultaneously transferring and fixing the toner image carried by the image carrier to a transfer material; and sending, by a registration roller pair, the transfer material to the transfer-fixing nip when a leading edge of the toner image on the image carrier reaches a predetermined position on the transfer material; and preheating, by a preheater formed in the roller registration pair, the transfer material before the transfer material enters the transfer-fixing nip.

8. The transfer-fixing device according to claim 1, wherein the registration roller pair is further configured to correct a conveyance direction or oblique misalignment of the transfer material.

9. The transfer-fixing device according to claim 1, wherein an ambient temperature in a space between the registration roller pair and the transfer-fixing nip is maintained to be higher than a room temperature.

10. The image forming apparatus according to claim 5, wherein the preheater includes a halogen heater incorporated into a first roller of the roller registration pair.

11. The image forming apparatus according to claim 5, wherein a first roller of the roller registration pair has an outer diameter of about 20 mm, and an aluminum core metal coated by silicon rubber.

12. The image forming apparatus according to claim 5, further comprising:

a supplementary heater configured to heat the toner image transferred and fixed to the transfer material after the transfer material passes through the transfer-fixing nip.

13. The image forming apparatus according to claim 5, wherein the registration roller pair is further configured to correct a conveyance direction or oblique misalignment of the transfer material.

14. The image forming apparatus according to claim 5, wherein an ambient temperature in a space between the registration roller pair and the transfer-fixing nip is maintained to be higher than a room temperature.

15. The transfer-fixing method according to claim 7, wherein the preheater includes a halogen heater incorporated into a first roller of the roller registration pair.

16. The transfer-fixing method according to claim 7, wherein a first roller of the roller registration pair has an outer diameter of about 20 mm, and an aluminum core metal coated by silicon rubber.

17. The transfer-fixing method according to claim 7, further comprising:

supplementary heating the toner image transferred and fixed to the transfer material after the transfer material passes through the transfer-fixing nip.

18. The transfer-fixing method according to claim 7, further comprising:

correcting, by the registration roller pair, a conveyance direction or oblique misalignment of the transfer material.

19. The transfer-fixing method according to claim 7, further comprising:

maintaining an ambient temperature in a space between the registration roller pair and the transfer-fixing nip to be higher than a room temperature.

20. The transfer fixing device according to claim 1, wherein a toner ½ melting temperature is 130 degrees centigrade.

21. The image forming apparatus according to claim 5, wherein a toner ½ melting temperature is 130 degrees centigrade.

22. The transfer fixing method according to claim 7, wherein a toner ½ melting temperature is 130 degrees centigrade.

* * * * *